US011031671B2

(12) United States Patent
Xia et al.

(10) Patent No.: US 11,031,671 B2
(45) Date of Patent: Jun. 8, 2021

(54) AOG ANTENNA SYSTEM AND MOBILE TERMINAL

(71) Applicant: AAC Technologies Pte. Ltd., Singapore (SG)

(72) Inventors: Xiaoyue Xia, Shenzhen (CN); Zhengdong Yong, Shenzhen (CN); Zhimin Zhu, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 3 days.

(21) Appl. No.: 16/524,092

(22) Filed: Jul. 28, 2019

(65) Prior Publication Data

US 2020/0052368 A1 Feb. 13, 2020

(30) Foreign Application Priority Data

Aug. 12, 2018 (CN) ..... 201810911473.5

(51) Int. Cl.

| | |
|---|---|
| ***H01Q 1/12*** | (2006.01) |
| ***H01Q 21/28*** | (2006.01) |
| ***H01Q 1/24*** | (2006.01) |
| ***H01Q 9/04*** | (2006.01) |
| ***H01Q 21/08*** | (2006.01) |

(52) U.S. Cl.

CPC ..... *H01Q 1/1271* (2013.01); *H01Q 1/243* (2013.01); *H01Q 9/0407* (2013.01); *H01Q 21/08* (2013.01)

(58) Field of Classification Search

CPC ..... H01Q 1/38; H01Q 1/243; H01Q 9/0407; H01Q 9/0457; H01Q 23/00; H01Q 21/0006; H01Q 1/1271; H01Q 21/28; H04M 1/0202; H02M 1/026

See application file for complete search history.

(56) References Cited

U.S. PATENT DOCUMENTS

| | | | | |
|---|---|---|---|---|
| 2019/0312334 | A1* | 10/2019 | Shin | H04M 1/0249 |
| 2020/0052367 | A1* | 2/2020 | Zhu | H01Q 9/0457 |
| 2020/0052372 | A1* | 2/2020 | Xia | H01Q 21/065 |
| 2020/0052394 | A1* | 2/2020 | Yong | H01Q 1/2283 |
| 2020/0212577 | A1* | 7/2020 | Xia | H01Q 21/28 |

FOREIGN PATENT DOCUMENTS

| | | | |
|---|---|---|---|
| CN | 101106583 | A1 | 1/2008 |
| CN | 101625730 | A1 | 1/2010 |

OTHER PUBLICATIONS

1st Office Action dated Sep. 10, 2019 by SIPO in related Chinese Patent Application No. 201810911473.5 (8 Pages).

* cited by examiner

*Primary Examiner* — Haissa Philogene
(74) *Attorney, Agent, or Firm* — W&G Law Group LLP

(57) ABSTRACT

The present disclosure provides an AOG antenna system and a mobile terminal. The AOG antenna system includes a 3D glass back cover and a main board arranged opposite to and spaced apart from the 3D glass back cover. The AOG antenna system includes: a metal antenna attached to a surface of the 3D glass back cover; and a packaged feeding module provided between the 3D glass back cover and the main board and electrically connected to the main board. The packaged feeding module corresponds to a position of the metal antenna and feeds the metal antenna with power by coupling.

7 Claims, 7 Drawing Sheets

AOG ANTENNA SYSTEM AND MOBILE TERMINAL

TECHNICAL FIELD

The present disclosure relates to the field of wireless communication technologies, and in particular, to an AOG (Antenna On Glass) antenna system and a mobile terminal.

BACKGROUND

With 5G being the focus of research and development in the global industry, developing 5G technologies and formulating 5G standards have become the industry consensus. The ITU-RWP5D 22nd meeting held in June 2015 by International Telecommunication Union (ITU) identified three main application scenarios for 5G: enhance mobile broadband, large-scale machine communication, and highly reliable low-latency communication. These three application scenarios respectively correspond to different key indicators, and in the enhance mobile broadband scenario, the user peak speed is 20 Gbps and the minimum user experience rate is 100 Mbps. Currently, 3GPP is working on standardization of 5G technology. The first 5G Non-Stand Alone (NSA) international standard was officially completed and frozen in December 2017, and the 5G Stand Alone standard was scheduled to be completed in June 2018. Research work on many key technologies and system architectures during the 3GPP conference was quickly focused, including the millimeter wave technology. The high carrier frequency and large bandwidth characteristics unique to the millimeter wave are the main means to achieve 5G ultra-high data transmission rates.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. The phases of respective array elements are caused to distribute according to certain regularity by a phase shifter, so that a high gain beam is formed and the beam is scanned over a certain spatial range through a change in phase shift.

With an antenna being an indispensable component in a radio frequency (RF) front-end system, it is an inevitable trend in the future development of the RF front-end to system-integrate and package the antenna with a RF front-end circuit while developing the RF circuit towards the direction of integration and miniaturization. The antenna-in-package (AiP) technology integrates, through package material and process, the antenna into a package carrying a chip, which fully balances the antenna performance, cost and volume and is widely favored by broad chip and package manufacturers. At present, companies including Qualcomm, Intel, IBM and the like have adopted the antenna-in-package technology. Undoubtedly, the AiP technology will also provide a good antenna solution for 5G millimeter wave mobile communication systems.

A metal middle frame with 3D glass is the mainstream solution for the future full-screen phone structure design, which can provide better protection, aesthetics, thermal diffusion, color and user experience. However, due to a higher dielectric constant of 3D glass, the radiation performance of the millimeter wave antenna will be seriously affected, and the antenna array gain will be reduced. Moreover, in the related antenna package technology, an overall thickness of the antenna system is relatively large, which does not satisfy the miniaturization requirement of the antenna system.

Therefore, it is necessary to provide a new antenna system and a new mobile terminal to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
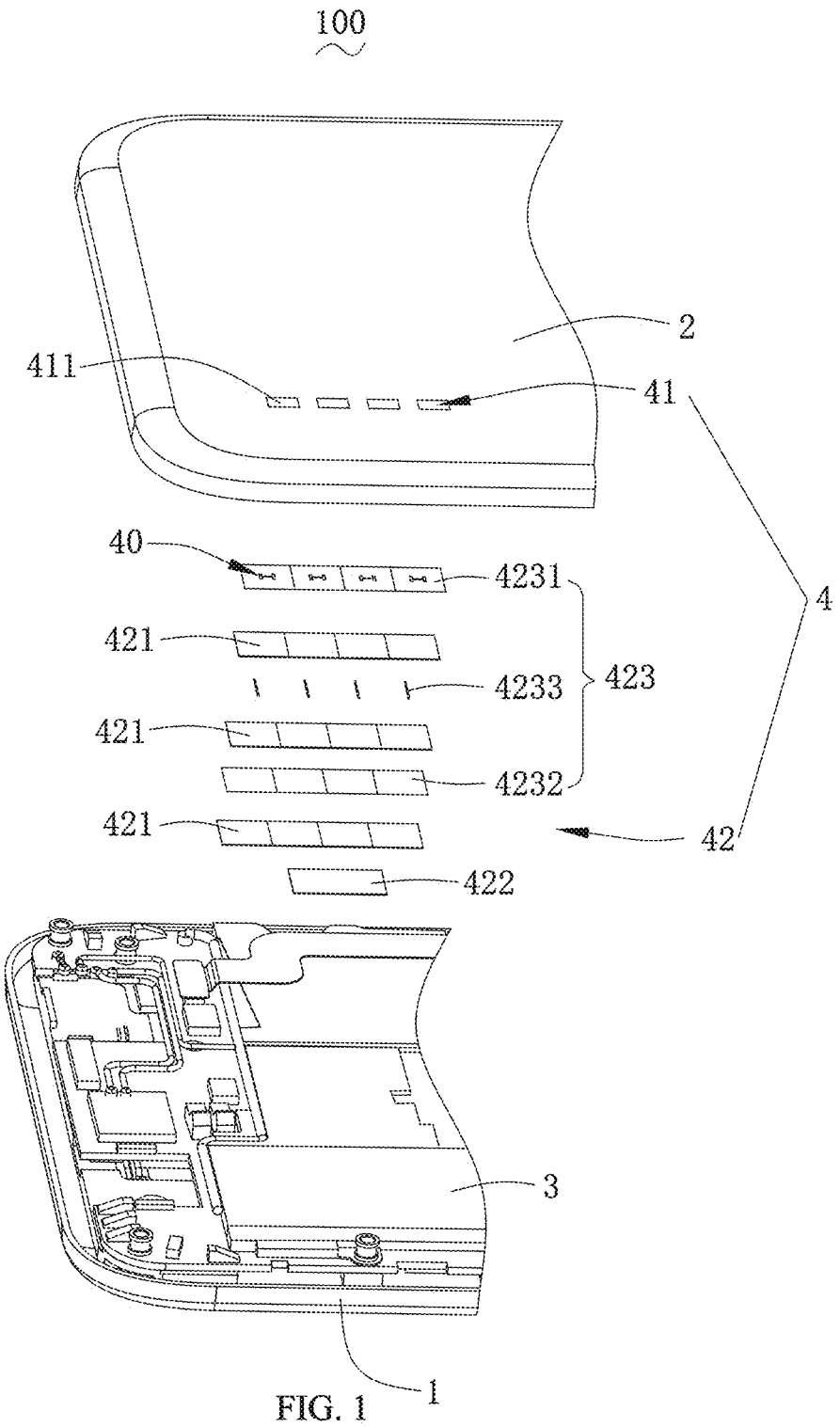
FIG. 1 is a perspective structural schematic diagram of a mobile terminal provided by the present disclosure.
Figure 2:
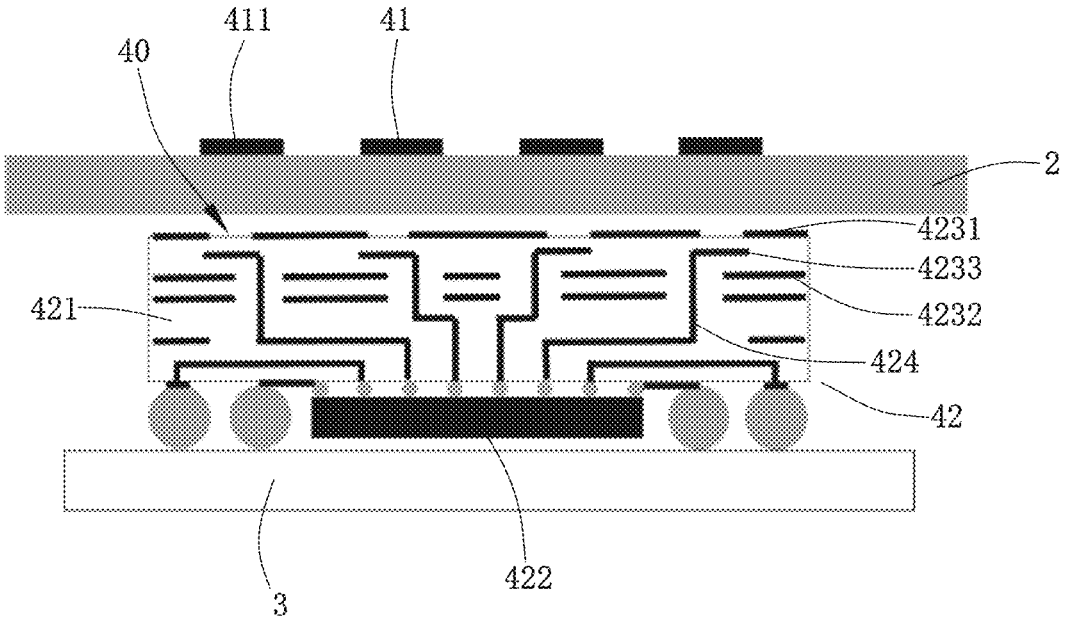
FIG. 2 is a plane structural schematic diagram of a partial structure of the mobile terminal shown in FIG. 1.
Figure 3:
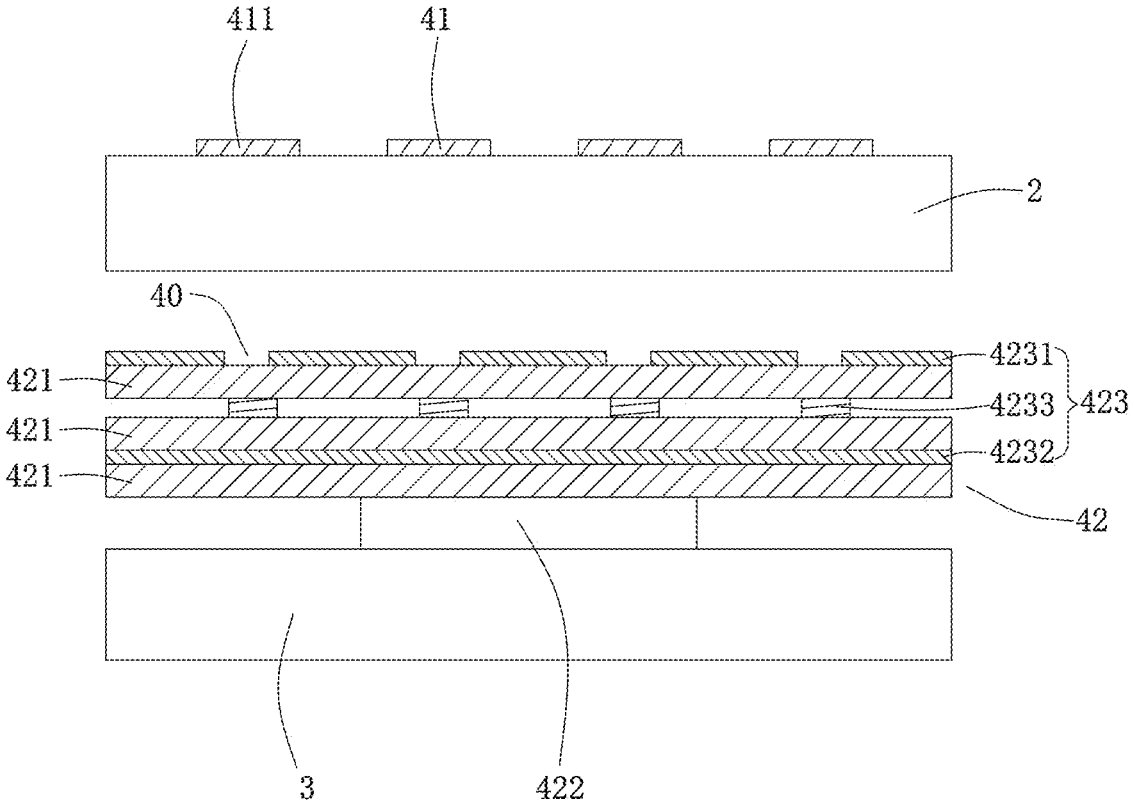
FIG. 3 is a hierarchical structure schematic diagram of a feeding network shown in FIG. 1.

As shown in FIGS. 1-3, the present disclosure provides a mobile terminal 100. The mobile terminal 100 may be a mobile phone, an iPad, a POS machine, etc., which is not limited by the present disclosure. The mobile terminal 100 includes a frame 1, a 3D glass back cover 2 covering and connected to the frame 1 and enclosing a receiving space with the frame 1, a main board 3 that is received in the receiving space and spaced apart from the 3D glass back cover 2, and an AOG antenna system 4 electrically connected to the main board 3.

The 3D glass back cover 2 can cover and be connected to the frame 1 by an adhesive, or the frame 1 and the 3D glass back cover 2 may be respectively provided with a corresponding buckle structure, such that the 3D glass back cover 2 can be fixedly connected to the frame 1 by a buckling manner. Alternatively, the frame 1 and the 3D glass back cover may be formed into one piece. The 3D glass back cover 2 can provide better protection, aesthetics, thermal diffusion, color and user experience.

The AOG antenna system 4 can receive and transmit electromagnetic wave signals, thereby achieving the communication function of the mobile terminal 100. Specifically, the AOG antenna system 4 can be connected to the main board 3 through BGA package technology.

The AOG antenna system 4 is a millimeter wave phased array antenna system. Specifically, the AOG antenna system 4 includes a metal antenna 41 provided on a surface of the 3D glass back cover 2, and a packaged feeding module 42 provided between the 3D glass back cover 2 and the main board 3 and electrically connected to the main board 3. The packaged feeding module 42 corresponds to a position of the metal antenna 41 and feeds the metal antenna 41 with power by coupling. It should be noted that the metal antenna 41 may be provided on an outer surface or an inner surface of the 3D glass back cover 2. The outer surface of the 3D glass back cover 2 is a face facing away from the main board 3, and the inner surface of the 3D glass back cover 2 is a face close to the main board 3.

In this embodiment, the metal antenna 41 may be selected from one of a square patch antenna, a ring patch antenna, a circular patch antenna, and a cross-shaped patch antenna. As an example, the metal antenna 41 may be a square patch antenna. Without doubt, in other embodiments, the metal antenna 41 may also use an antenna of other forms.

Each of the surfaces of the 3D glass back cover 2 may be designed as a planar surface, alternatively, part of the surfaces are designed as a planar surface and the other part of the surfaces are designed as a curved surface, so as to meet the needs of different users. The metal antenna 41 is formed on the surface of the 3D glass back cover 2 by a printed conductive silver paste method or a printed LDS ink method. Moreover, in order to prevent the metal antenna 41 from affecting the beauty degree of the mobile terminal 100, the metal antenna 41 may be designed to be located near the Logo. Alternatively, a protective film may be applied to the surface of the metal antenna 41, which not only avoids affecting the beauty degree but also protects the antenna. The protective film is preferably a low dielectric thin film or plastic.

Further, the metal antenna 41 is a one-dimensional linear array, occupies a narrow space in the mobile phone, and is scanned only in one perspective, which simplifies design difficulty, test difficulty, and beam management complexity. As an example, the metal antenna 41 may be a linear array of 1×4, i.e., the metal antenna 41 includes four metal antenna units 411.

The packaged feeding module 42 includes a substrate 421, an integrated circuit chip 422 provided on a side of the substrate 421 facing towards the main board 3, and a feeding network 423 provided in the substrate 421 and arranged opposite to the metal antenna 41, and a circuit 424 connecting the feeding network 423 with the integrated circuit chip 422. The feeding network 423 feeds the metal antenna 41 with power by coupling, and the circuit 424 is electrically connected to the main board 3.

The substrate 421 is used to carry the feeding network 423. The substrate 421 may be formed as a whole or may be arranged by layers.

The integrated circuit chip 422 is fixedly connected to the substrate 421 by the flip-chip bonding process.

The feeding network 423 is a strip wire having impedance that is easy to control and having better shielding, which can effectively reduce the loss of electromagnetic energy and improve the antenna efficiency. The feeding network 423 includes a first metal layer 4231 close to the metal antenna 41, a second metal layer 4232 arranged opposite to and spaced apart from the first metal layer 4231, and a strip wire layer 4233 sandwiched between the first metal layer 4231 and the second metal layer 4232.

The first metal layer 4231 is provided with a slit 40 at a position corresponding to the metal antenna 41, and the feeding network 423 feeds the metal antenna 41 with power by coupling via the slit 40.

The number of the slits 40 matches the number of the metal antenna units 411 and each of the metal antenna units 411 is fed with power by the feeding network 423 by coupling via the slit 40. Specifically, electromagnetic energy is coupled to the metal antenna unit 411 through the slit 40. In this embodiment, the number of the slits 40 is four, and each of the slits 40 is provided corresponding to one of the metal antenna units 411. The cross-sectional shape of the slit 40 is in an I-shape. In other embodiments, the cross-sectional shape of the slit 40 may be square, circular or triangular, which is not limited in the present disclosure.

Further, an orthographic projection of the slit 40 towards the metal antenna unit 411 completely falls within the range of the metal antenna unit 411.

Even further, the packaged feeding module 42 is stacked by a PCB process or an LTCC process.

Compared with the antenna-in-package, the AOG antenna system 4 in this embodiment is provided with the metal antenna 41 on the 3D glass back cover 2, and is only provided with the feeding structure on the substrate 421 and uses it as a package structure of the integrated circuit chip 422, which can reduce the space occupied by the AOG antenna system 4 as a whole. Specifically, according to the bandwidth of n257 of the 5G communication and taking a 1×4 array as an example, a thickness of the AOG antenna system 4 can be reduced by at least 0.4 mm, and its area is reduced from 5.5 mm×12 mm to 3 mm×10 mm.

Moreover, in this embodiment, the 3D glass back cover 2 has a dielectric constant of 6.3+i0.039 and a thickness of 0.7 mm; the substrate 421 of the packaged feeding module 42 is formed by pressing 6 layers of high-frequency low-loss PCB sheets, in which a core layer is pressed with Rogers4350B and has a thickness of 0.254 mm, while the remaining dielectric layers are pressed with Rogers4450F and have a thickness of 0.2 mm. Without doubt, it should be noted that the present disclosure does not limit the dielectric constant of the 3D glass back cover 2, nor does it limit the number, thickness, and manufacturing manner of the substrate 411 of the packaged feeding module 42.

Figure 4A:
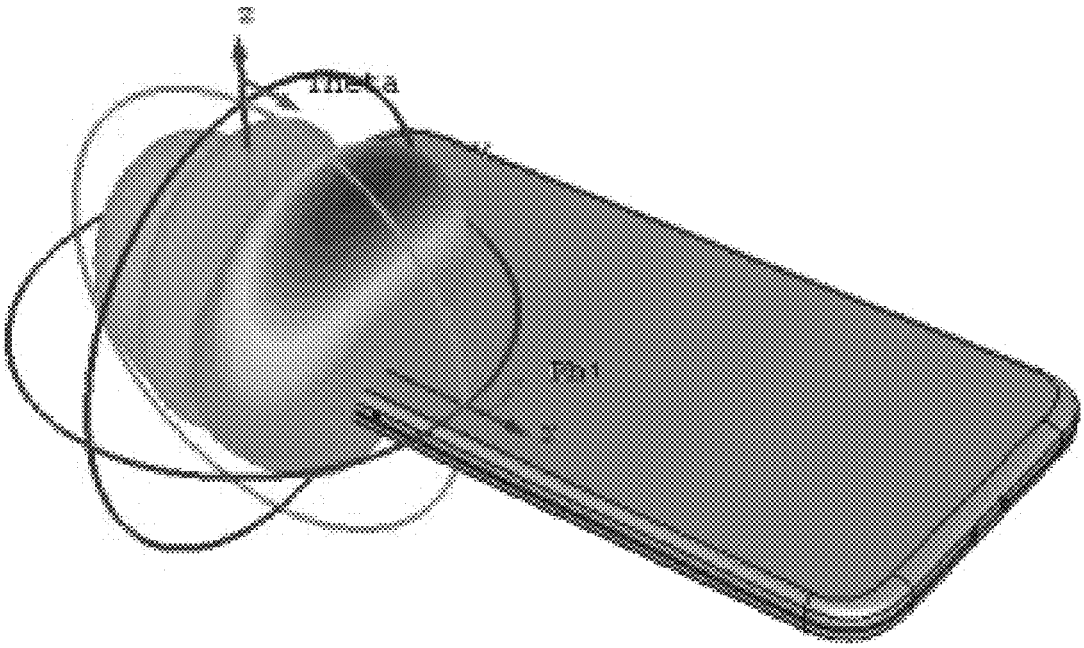
FIG. 4A illustrates a radiation pattern with a phase shift of each metal antenna unit being 45° in an AOG system provided by the present disclosure.
Figure 4B:
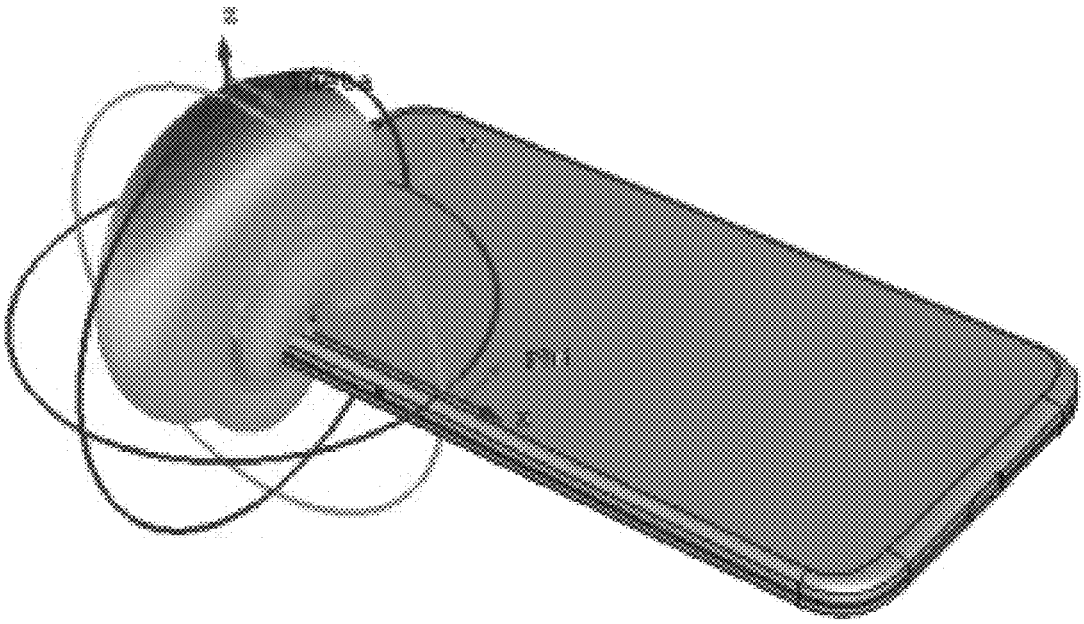
FIG. 4B illustrates a radiation pattern with a phase shift of each metal antenna unit being 0° in an AOG system provided by the present disclosure.
Figure 4C:
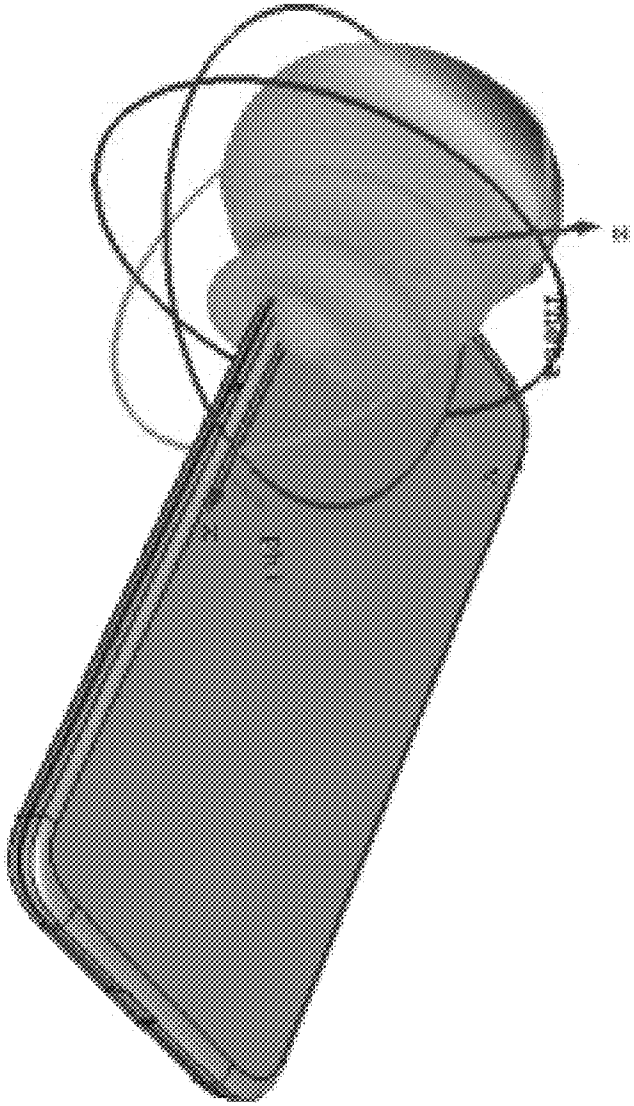
FIG. 4C illustrates a radiation pattern with a phase shift of each metal antenna unit being −45° in an AOG system provided by the present disclosure.
Figure 5:
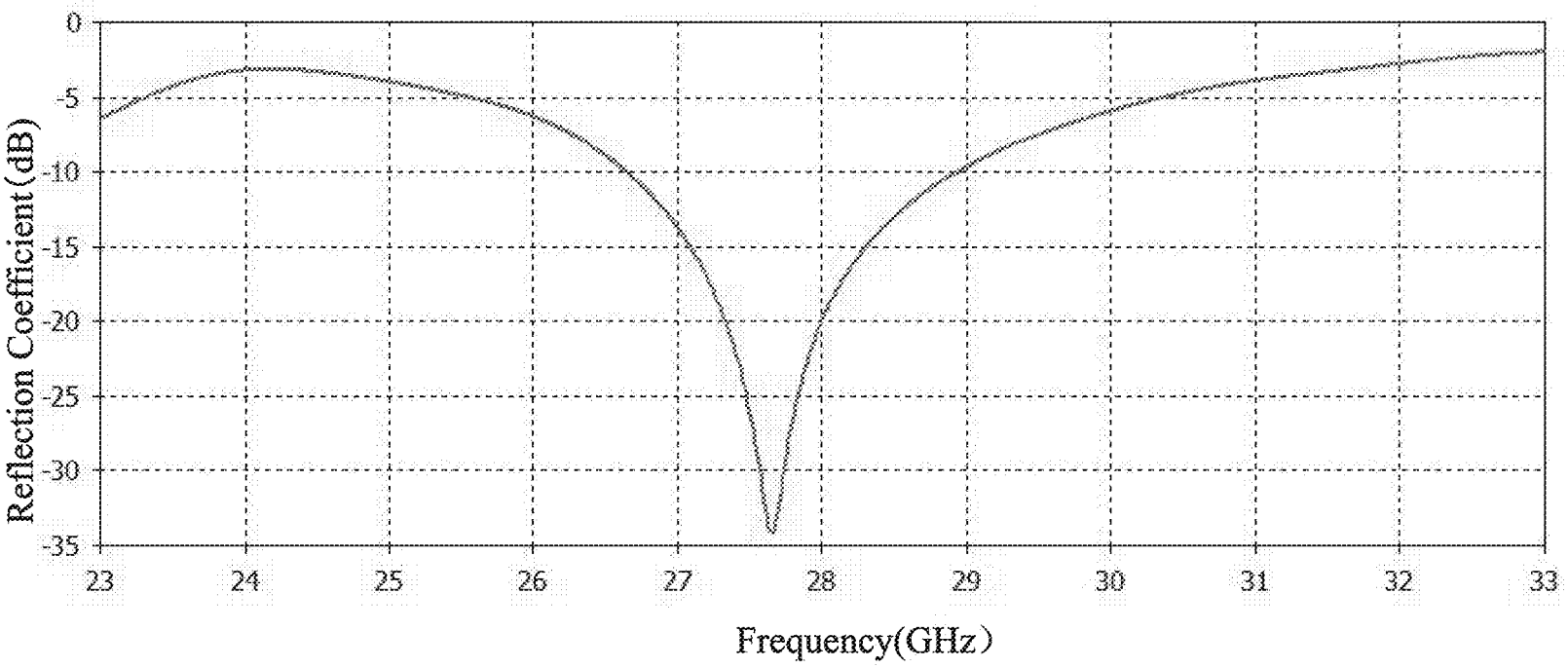
FIG. 5 illustrates a reflection coefficient graph of an AOG system provided by the present disclosure.

Referring to FIG. 4A to FIG. 6, FIG. 4A illustrates a radiation pattern with a phase shift of each metal antenna unit being 45° in an AOG system provided by the present disclosure, FIG. 4B illustrates a radiation pattern with a phase shift of each metal antenna unit being 0° in an AOG system provided by the present disclosure, FIG. 4C illustrates a radiation pattern with a phase shift of each metal antenna unit being −45° in an AOG system provided by the present disclosure, and FIG. 5 illustrates a reflection coefficient graph of an AOG system provided by the present disclosure.

Generally, due to the high dielectric constant of 3D glass, using it as the back cover of the mobile phone seriously may affect the radiation performance of the antenna system received therein, reduce the radiation efficiency and the gain, and results in the distortion of the radiation pattern due to the influence of surface waves. In the present disclosure, by using the 3D glass back cover 2 as a dielectric substrate of an antenna and transmitting electromagnetic energy from the packaged feeding module 42 to the metal antenna 41 by coupling so as to radiate outwardly, the effect of the 3D glass back cover 2 on the antenna system is greatly reduced and the antenna efficiency is improved, thereby avoiding the distortion of the radiation pattern and maintaining good working state.

Figure 6:
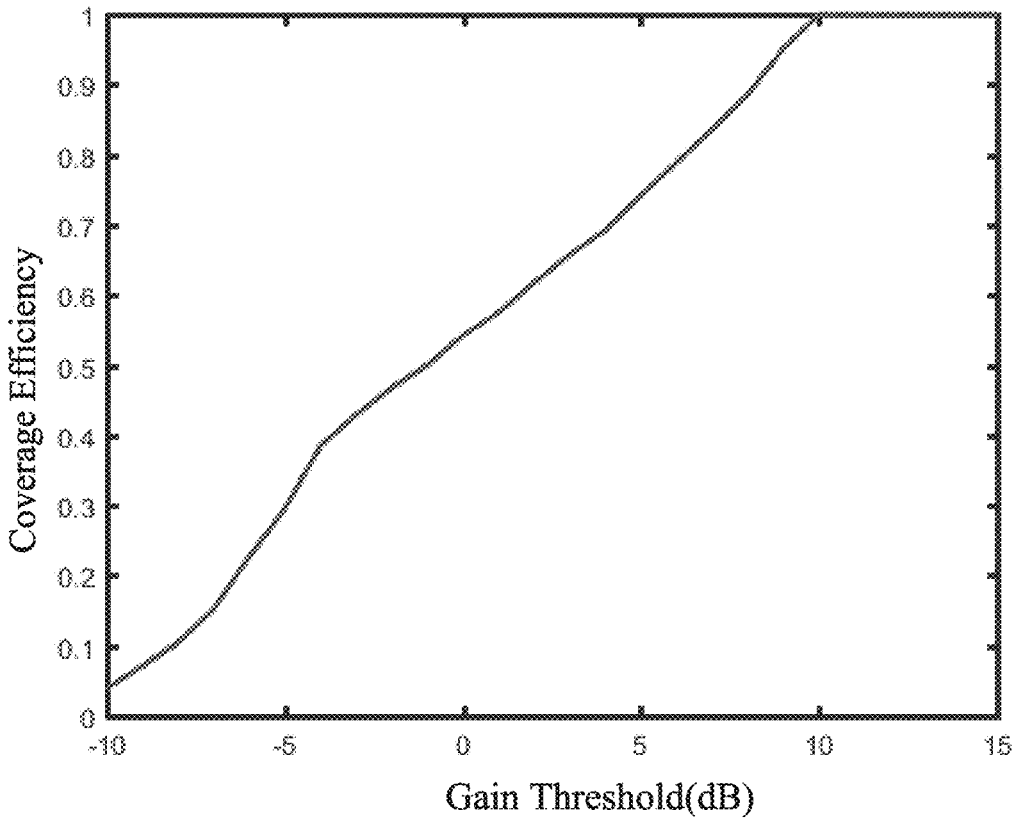
FIG. 6 illustrates a coverage efficiency graph of an AOG system provided by the present disclosure.

Referring to FIG. 6, FIG. 6 illustrates a coverage efficiency graph of an AOG antenna system provided by the present disclosure. As can be seen from FIG. 6, in the case where the coverage efficiency is 50%, the gain threshold of the AOG antenna system 4 is decreased by 12 dB, while in the 3GPP discussion, the gain threshold is reduced by 12.98 dB for the case of 50% coverage efficiency, showing that the AOG antenna system 4 of the present disclosure has the better coverage efficiency.

Compared with the related art, the AOG antenna system 4 and the mobile terminal 100 provided by the present disclosure have the following beneficial effects. By providing the metal antenna 41 on the surface of the 3D glass back cover 2 and feeding the metal antenna with power by coupling with the packaged feeding module 42, the effect of the 3D glass back cover on the antenna system can be greatly reduced, increasing the antenna radiation efficiency and reducing the gain reduction, thereby achieving the communication effect and reducing the space occupied by the AOG antenna system 4. The millimeter wave phased array antenna system adopts a linear array instead of a planar array, so as to occupy a narrower space in the mobile phone and to perform scanned in one perspective, which simplifies design difficulty, test difficulty and beam management complexity.

What has been described above is only an embodiment of the present disclosure, and it should be noted herein that one ordinary person skilled in the art can make improvements without departing from the inventive concept of the present disclosure, but these are all within the scope of the present disclosure.

What is claimed is:

1. An Antenna On Glass (AOG) antenna system applied to a mobile terminal, the mobile terminal comprising a 3D glass back cover and a main board arranged opposite to and spaced apart from the 3D glass back cover, the AOG antenna system comprising:

a metal antenna attached to a surface of the 3D glass back cover; and a packaged feeding module provided between the 3D glass back cover and the main board and electrically connected to the main board, wherein the packaged feeding module corresponds to a position of the metal antenna and feeds the metal antenna with power by coupling;

wherein the AOG antenna system is a millimeter wave phased array antenna system;

wherein the packaged feeding module comprises a substrate, an integrated circuit chip provided on a side of the substrate facing towards the main board, a feeding network provided in the substrate and arranged opposite to the metal antenna, and a circuit connecting the feeding network with the integrated circuit chip, the feeding network feeding the metal antenna with power by coupling and the circuit being electrically connected to the main board;

wherein the feeding network is a strip wire, and the strip wire comprises a first metal layer close to the metal antenna, a second metal layer arranged opposite to and spaced apart from the first metal layer, and a strip wire layer sandwiched between the first metal layer and the second metal layer, the strip wire layer being spaced apart from the first metal layer and the second metal layer, the first metal layer being provided with at least one slit at a position corresponding to the metal antenna, the feeding network feeding the metal antenna with power by coupling via the at least one slit, and the strip wire layer being electrically connected to the circuit.

2. The AOG antenna system as described in claim 1, wherein the metal antenna is a one-dimensional linear array comprising a number of metal antenna units, the at least one slit comprises a number of slits matching the number of the metal antenna units, and each of the metal antenna units is fed with power by coupling with the feeding network via its corresponding one of the number of slits.

3. The AOG antenna system as described in claim 2, wherein an orthographic projection of each of the number of slits towards a direction of its corresponding metal antenna unit is completely within a range of the metal antenna unit.

4. The AOG antenna system as described in claim 1, wherein the metal antenna is formed on the surface of the 3D glass back cover by a printed conductive silver paste method or a printed LDS ink method.

5. The AOG antenna system as described in claim 1, wherein the metal antenna is selected from a square patch antenna, a ring patch antenna, a circular patch antenna, and a cross-shaped patch antenna.

6. The AOG antenna system as described in claim 1, wherein a surface of the metal antenna is coated with a protective film.

7. A mobile terminal, comprising the antenna system as described in claim 1.

* * * * *